United States Patent [19]

Wiser

[11] 4,070,025

[45] Jan. 24, 1978

[54] TILTABLE GAME SURFACE DEVICE

[76] Inventor: John A. Wiser, P.O. Box 192, Liberty, Tex. 77575

[21] Appl. No.: 766,208

[22] Filed: Feb. 7, 1977

Related U.S. Application Data

[63] Continuation-in-part of Ser. No. 625,843, Oct. 28, 1975, Pat. No. 4,023,806.

[51] Int. Cl.[2] ..... A63F 7/10; A63B 67/14

[52] U.S. Cl. ..... 273/110; 273/122 R

[58] Field of Search ..... 273/110, 113, 85 R, 273/109, 115, 116, 121 R, 121 A, 122 R

[56] References Cited

U.S. PATENT DOCUMENTS

| | | | |
|---|---|---|---|
| 3,061,312 | 10/1962 | Glass et al. | 273/110 |
| 3,787,055 | 1/1974 | Kraemer | 273/110 |
| 3,931,972 | 1/1976 | Fabian | 273/85 R |

FOREIGN PATENT DOCUMENTS

| | | | |
|---|---|---|---|
| 1,311,080 | 10/1962 | France | 273/110 |
| 848,767 | 9/1952 | Germany | 273/85 R |
| 441,662 | 1/1936 | United Kingdom | 273/110 |

*Primary Examiner*—Richard C. Pinkham
*Assistant Examiner*—Lawrence E. Anderson
*Attorney, Agent, or Firm*—Kenneth H. Johnson

[57] ABSTRACT

A tiltable game surface device comprising a game surface mounted in a housing by a plurality of springs connecting the game surface to the housing and urging the game surface toward the base of said housing, and into parallel relation with the base, at least four levers mounted in the housing for raising various portions of the game surface such that actuating one lever will cause one quadrant of the game surface associated with said lever to rise out of parallel with base, thereby causing a game ball on the surface to move by gravity.

10 Claims, 6 Drawing Figures

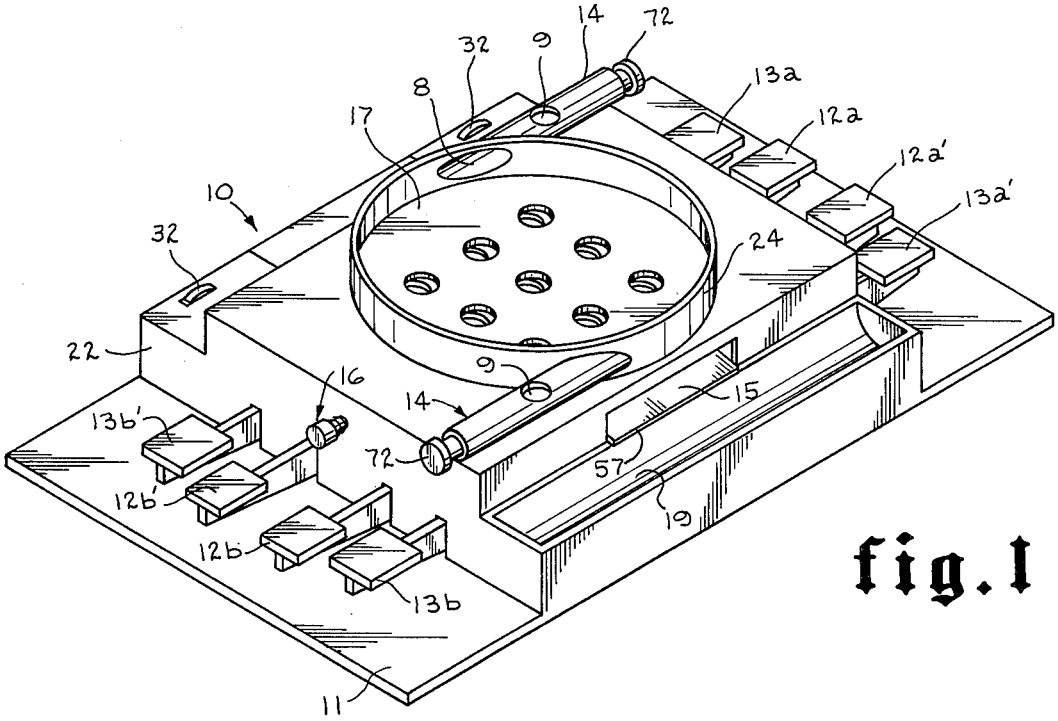
fig.1
fig.6
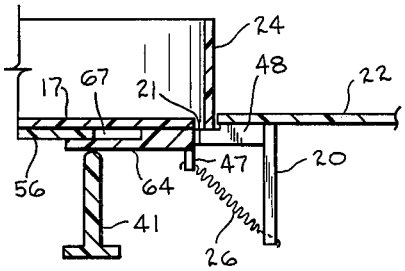
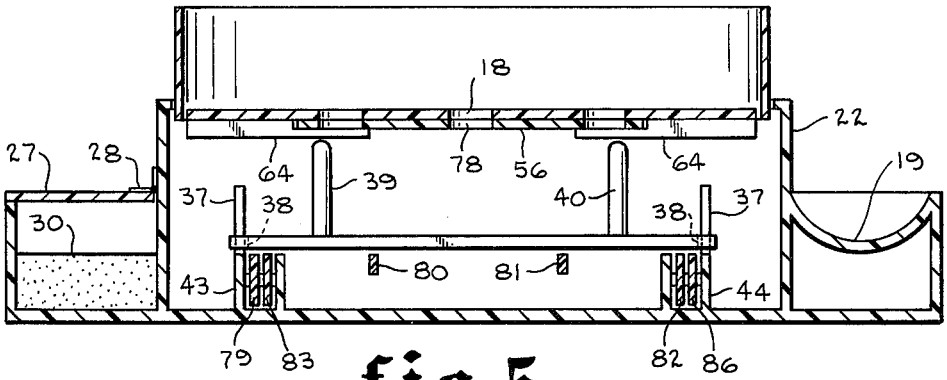
fig.5

TILTABLE GAME SURFACE DEVICE

This application is a continuation-in-part of Ser. No. 625,843, filed Oct. 28, 1975, now U.S. Pat. No. 4,023,806.

BACKGROUND OF THE INVENTION

The present invention relates to a tiltable gameboard surface to be used for a ball, such as a marble, and manipulatable through indirect means. The present tiltable surface will be adapted to have openings therein for the ball to enter. Preferably, the openings may be partially blocked by a movable means so that the ball or balls may be maintained on the surface. Games which may be played on the tiltable surface are ether conventional games, such as Tic Tac Toe, or newly devised games of skill to be used with a tiltable surface.

The game surface is tiltable by manipulation of levers, so that in effect the surface is tiltable to almost any angle. This is easily achieved by the use of four levers, which are described hereinafter. The device of the present invention may be equipped with only one set of levers, however, preferably there are two sets of levers, which perform duplicate functions respectively from either side of the device. Thereby allowing the game to be played by two individuals without the need for rotating the game device or movement of the individuals playing the game. In any event, the game may be played by one individual or by any number of additional individuals, either by using one group of control levers or by using the two sides of the control levers, either rotationally or otherwise.

It is the object of the game, to take a conventional game such as Tic Tac Toe which requires some mental skill to be played successfully, and to add to that skill the manipulative skill in tilting the surface of the board. Although one may have a predetermined idea or notion of where to put a particular ball in order to win a game or to block an opponent, the physical manipulation adds an extra element of chance and skill to the game of Tic Tac Toe.

There are a large number of game devices which have tiltable surfaces. These may be divided into two classes, for convenience, those which are similar to the present device, in that the tilt surfaces are manipulated indirectly and which are represented by such U.S. Pat. Nos. as: 2,562,126; 3,061,312; 3,384,374; 3,643,952; 3,787,055 and British Pat. Specification No. 441,662; and those wherein the gameboard is manipulated by direct hand tilting thereof, as represented by U.S. Pat. Nos.: 2,788,974; 3,008,716; 3,236,522; and 3,690,663.

Although the prior art patents achieve the same result, i.e., tilting of the gameboard surface, their manner of operation is for the most part very different from the present invention. The present game device is unique in that there are strategically arranged levers which are manipulated either individually or in union or sequence by the fingers of one or both hands of the player, so that the gameboard is in effect played much as one plays a piano. Operation of the game gives one much the same feeling as being a master of any keyboard in manipulating the game surface so as to achieve the desired result. Although the ultimate aim of the game is to develop a high degree of precision in manipulation of the game surface by slight and delicate pressure on the levers, even small children can quite successfully play this game, since there is an element of chance and even a skilled manipulator can fail to attain the positioning of the ball in the appropriate opening, or within a specified time.

The device is designed to be operable even on a moving vehicle such as an automobile or airplane or sea vessel.

Unlike many games of this type, the manner in which the surface is tilted can require a high degree of skill and tends to interest one much as skill games such as billiards and golf which are all basically simple, however difficult in application. In the following summary and description the game will be described in regard to a particular, highly refined embodiment, however it should be appreciated that there are a number of modifications which are within the conception of the invention, and which are readily apparent to one after reviewing the drawings and specification. For example the present invention will be described in regard to a playing surface having a circular configuration. Although this is preferred it is readily apparent that a rectangular, square, triangular or other shape of playing surface could just as easily be employed. For these various shapes, excluding the triangle, the four lever arrangement to be described would be employed. However for the triangular playing surface only a three lever arrangement need be employed, which would be manipulated by the fingers of one hand, in the same manner as to be described hereinafter, with one lever each controlling a point of the triangle. Other obvious modifications which are within the scope of the present invention include the arrangement of the openings on the game surface. As shown in the drawings and used to describe the present mechanism, an arrangement suitable for playing Tic Tac Toe is provided. However the game surface could be arranged with random holes placed thereon and barriers on the surface, with various point indications for various openings. In fact it is within the purview of the present invention to have a removable game surface wherein a number of games could be played thereon using the device by changing the surface. Other refinements depicted in the drawings, which are not necessary, are shooting devices for placing the game ball onto the surface (it is readily appreciated that the game ball could merely be placed at a neutral portion of the surface by hand, and the manipulation begun at that point. Another refinement is the use of leveling devices, which although useful would not be necessary, provided the same starting point was used by each of the players.

SUMMARY OF THE INVENTION

Briefly described the present invention is a tiltable game surface device, wherein the game surface is movably mounted in relation to a base of a housing. At least three lever means are provided to raise the game surface at least at three points, each of said points being at least 60° apart. More specifically the invention is a tiltable game surface device comprising a housing, a game surface having an opening therein and movably mounted to said housing, and at least four adjacent lever means mounted on the said base of said housing, two of each lever means each being associated with one bar of a pair of bars, one each of said bars being vertically movable and operably aligned below and with said game surface and having two members thereon extending toward said game surface at points at least 60° apart and preferably at or near the periphery of the game surface.

The game surface is preferably circular, however it may be square, rectangular, triangular, octagonal, or the like. Extending about the game surface is a retaining wall which is not attached to the game surface. The retaining wall is seated on the housing and may be attached thereto. There may be a transparent cover which is either fixed or removable attached to the retaining wall. The game surface is mounted in the housing by a biasing means such as a helical coil spring or spring so that the game surface is substantially parallel to the base of the housing when the lever means are at rest. Thus if the base is leveled, the game surface will be level. The game surface may be fixedly or removably seated in the housing. It is preferable that the game surface be removable so that game surfaces for different games may be placed therein as desired.

In a preferred embodiment a releasable closure means is provided to partially block the holes in the game surface so that the game ball or balls will remain seated on the game surface, i.e., seated in the depression formed by the hole. Upon release of the closure means, openings therein line up with the openings in the game surface and the game ball or balls drop through into the housing and are recovered therefrom for reuse.

It is contemplated that an inexpensive version of the present invention would have openings in the game surface which were only indentation designed to hold a game ball and recovery of the ball would be by removing the ball from the opening. It has been found, however, that a releasable closure means is a convenient way to quickly clear the game board and collect all of the game balls in one location. Hence the term opening, as used herein, includes holes and indentations. Of course any hole can be employed as described above as merely an indentation by using balls of diameter greater than the hole diameter.

The present inventor realizes that much of the permutation description set out is readily apparent or statement of obvious fact, however, the inventor wished to point out that the basic invention is in relation to the means of manipulation of the game surface, to bring a ball into an opening. A further particular embodiment as disclosed and claimed relates to a releasable closure means associated with the game surface. Other embodiments are described and claimed herein also, which tend to be further improvements on the basic invention.

DRAWINGS

FIG. 1 is a perspective view of one embodiment of the present tiltable game board device showing a circular game board with an arrangement of openings therein, suitable for playing Tic Tac Toe, and tiltable by operation of four levers on opposed ends of the device.

FIG. 5 is a cross-sectional elevation of the device taken along line 5—5 of FIG. 2.

FIG. 6 is a detailed cross-sectional elevation of the means for biasing and attaching the game surface to the housing taken along line 6—6 of FIG. 2.

DETAILED DESCRIPTION OF THE INVENTION

Figure 2:
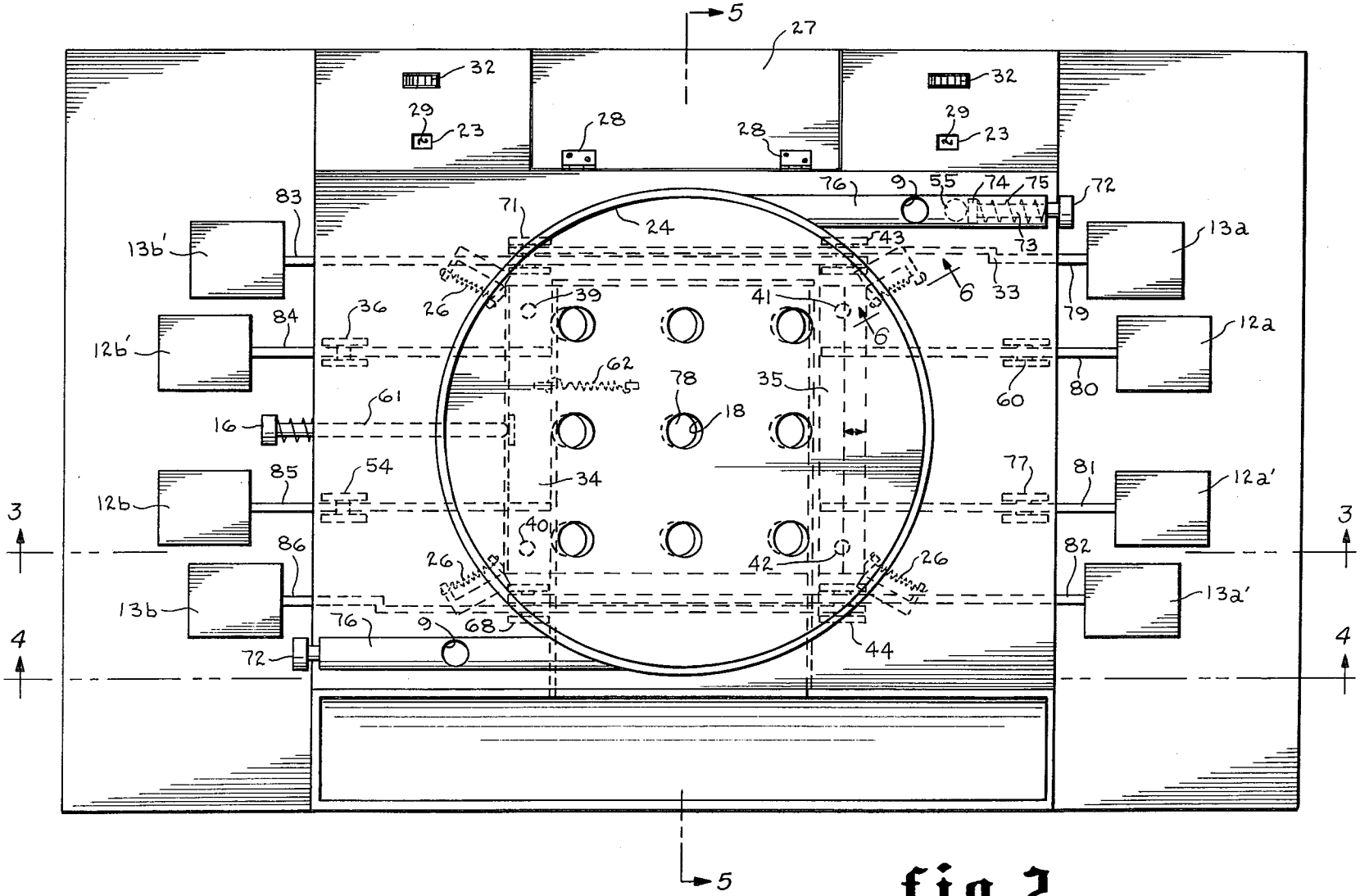
FIG. 2 is a top view in plan, showing in particular the arrangement of levers in regard to the tiltable game surface.

The present invention may be best understood by reference to the drawings. Referring now to FIG. 1, the present tiltable game surface device is shown in perspective. The game is played with a ball such as a marble, which is placed onto the game surface by putting the marble into the shooter 14. The shooter is a more or less conventional plunger type spring actuated device found in marble games. Referring now to FIG. 2, the shooter 14 is illustrated. The shooter is comprised of a tube 76, having an opening 9 therein through which a ball 55 is placed into the shooter 14. The handle 72 is connected to a rod 73 which terminates in plunger 74. The plunger is biased against helical compression spring 75, which when compressed and released by hand will throw the ball 55 along the tube 76 through opening 8 onto the game surface 17. The opening 8 is located in retaining wall 24 above the game surface 17 which prevents a ball from reentering tube 76 from the game surface 17. The shooter 14 is mounted to retaining wall 24.

Before the ball is placed onto the game surface 17 the game device 10 may be leveled by means of the leveling legs (not shown) located on the base 11 of the game device 10.

Once the ball is on the game surface, the object of the game is to manipulate the level of the surface, thereby causing the ball to enter into one of the openings 18 on the game surface 17. This is done by a player manipulating one set of lever assemblies 12 and 13. By depressing the lever assemblies a portion of the game surface 17 is caused to rise out of its substantially parallel normal at-rest position with the base 11, thereby causing the ball to roll by means of gravity about the surface. In the drawings the levers designated 12, both 12*a*, 12*b*, 12*a'*, and 12*b'* are the proximal lever assemblies, which when depressed cause a portion of the game surface 17 adjacent to the levers to rise out ot its level configuration. The 13 levers, i.e., 13*a*, 13*b*, 13*a'* and 13*b'*, are the distal levers which when actuated to downward pressure of the hand cause a distal portion of the game surface 17 to rise out of the level configuration.

Referring now to FIG. 2, the operation of the lever assemblies will be described in more detail. FIG. 2 is an in plan top view of the device. The "*a*" side of the device is to right of FIG. 2 and the "*b*" side to the left. Each lever assembly is comprised of a tread 25 and an arm associated as follows: arm 79, 80, 81, 82, 83, 84, 85 and 86 and lever assembly 13*a*, 12*a*, 12*a'*, 13*a'*, 13*b'*, 12*b'*, 12*b*, and 13*b* respectively. As hereinbefore stated the 13 levers are all distal levers. This can be seen in FIG. 2 as follows: Lever assembly 13*a* has the arm 79 which extends under the game surface 17 and contacts beam 34 in the area of rod 39 which is vertically mounted on beam 34, said rod 39 extending to and juxtaposed to the lower side of game surface 17. When the lever assembly 13*a* is actuated by downward pressure of the hand, the arm 79 which it is pivotally mounted in assembly 43 rises, thereby causing the beam 34 to rise in the area of rod 39 and to thereby raise that portion or quadrant of the game surface 17 located adjacent to rod 39. Similarly when lever assembly 13*a'* is actuated, it pivots in assembly 44 (FIG. 5) and forces the beam 34 and rod 40 upward against the game surface 17, thereby raising that quadrant of the game surface. If both 13*a* and 13*a'* are pressed at the same time, either with the same degree of downward movement or with varying degrees of downward movement, the entire distal side of game surface 17 will be forced upward by the pressure of the arms 79 and 82 by rods 39 and 40 respectively.

The 12 levers, as stated hereinbefore, are the proximal lever assemblies. When lever 12*a* is depressed it rotates about in assembly 60 in which it is pivotally mounted, thereby causing the arm 80 to force beam 35 upward raising rod 42 which is vertically mounted on beam 35, said rod 42 extending to and juxtaposed to the lower side of game surface 17, thereby forcing the game surface 17 upward at this point. Again if lever assembly 12*a'* is actuated (pivoting arm 81 in assembly 77), either independently or at the same time as lever 12*a*, the beam 35 is forced up by the arm 81 at point raising rod 41 and the corresponding quadrant of the game surface 17.

By the same analysis, the operation of the 12*b*, 12*b'*, 13*b* and 13*b'* can be made. The two ends of the device depicted in this embodiment are the reversed mirror images. Note for example that lever assemblies 13*a'* and 13*b'* are distal levers, (pivotally mounted is assemblies 44 and 71 respectively) contacting their respective beams 34 and 35 inside of the adjacent lever arms and both arms 79 and 86 have angles 33 in the arm to allow the respective arms to go around the incoming lever arms (83 and 82 of lever assemblies 13*a'* and 13*b'* respectively) from the opposite side. The 12*b*, 12*b'*, 13*b* and 13*b'* lever assemblies are pivotally mounted in assembly 54, assembly 36, assembly 68 and assembly 71 respectively. The levers are maintained in the at-rest position as shown for example in FIG. 1 by biasing means such as coil springs (not shown) attached to the lever arms as appropriate and by means of a particularly strong coil springs 26 attached to the game surface 17 and to the housing 22, as shown in FIG. 2. The beams 34 and 35 are attached to neither the lever arms 33 nor to game surface 17, but are allowed to move freely between the two and ride on ribs 37 along slots 38 in each of the beams. It is readily apparent, as stated above, that the manipulation of lever 13*b'* will cause the beam 35 to rise and raise rod 41; manipulation of lever assembly 12*b'* will cause beam 34 and rod 39 to rise; and finally manipulation of lever assembly 13*b* will cause beam 35 and rod 42 to rise.

In actual operation of the game device, once one has become somewhat adept and skilled at its handling, all of the levers on one side are arranged to be manipulated by the fingers of one or both hands. By varying the amount of pressure and the combination of lever assemblies which are depressed one can very accurately, with practice, move the ball about the game surface, with an almost surprising degree of control over the ball.

As stated hereinbefore the purpose of the manipulation of the ball on the game surface 17 is to seat the ball in the openings in the game surface. In the embodiment shown in the Figures of the present application, the openings are arranged for a game such as Tic Tac Toe. Thus it is the purpose of the manipulation of the game surface to manipulate the ball into one of the openings (there of course could be more than one ball present on the game surface at a time, thereby compounding the difficulty in manipulating the ball thereon). It is within the scope of this invention that the game ball could merely drop into the opening and fall through into a container, or to fall through an opening and to pass out through a ball return opening 15 into the ball receptacle 19. However it is preferably, particularly if a game pitting one player against another player is to be carried out, or one player against the clock, to have the game ball seat into an opening but not fall through into the housing. This is obtained by means of a closure plate 56 which is mounted preferably onto the underside of the game surface.

Figure 3:
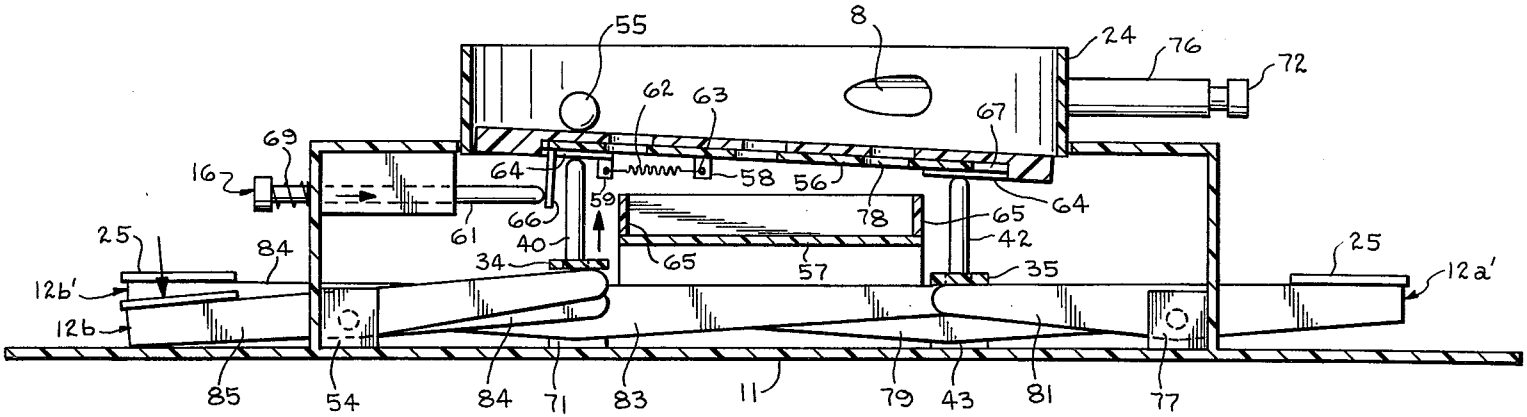
FIG. 3 is a cross-sectional elevation of the device of the present invention showing the relationship of the levers to the tiltable game board surface, in one mode of operation by hand manipulation, taken along line 3—3 of FIG. 2.

The closure plate in its closed configuration is best seen in FIG. 3, which depicts the release mechanism as depicted in FIG. 1 of the present invention. The game surface 17 is shown seated on rods 40 and 42 (similarly the game surface rest on rods 39 and 41) in the housing 22. The game surface is attached to the housing 22 by the four tension coil springs 26 and biased downward thus holding the lever assemblies at rest. The closure plate consists of openings, i.e., holes, 78 therein which are arranged to correspond to the holes or openings 18 in the game surface 17. In FIG. 3, the closure plate is shown to be in its closed position wherein the holes 78 are offset from the holes 18 in the game surface, thereby forming a seat into which a ball 55 will seat, which by selection of the appropriate size ball, will not allow the ball to pass through the two openings until they are aligned. The closure plate is held out of alignment by means of tension coil spring 62 which is mounted at point 63 to member 58 which is affixed to the closure plate 56 and to member 59 which attached to the closure plate support 64. There is a channel 67 shown in FIG. 3 on one end of the closure plate 56 formed by the closure plate support 64 and the game surface 17 into which the closure plate can slide. Thus the closure plate is slidably mounted between the supports 64 and the game surface 17 within the housing 22. There is a spring 62 as stated, which is mounted to the member 58 and attached to the member 59, thereby biasing the closure plate out of alignment so that the holes 78 therein are out of alignment with the holes or openings 18 in the game surface.

A further refinement is shown in FIG. 2 in that score recording devices are provided which are each comprised of a score wheel 29 connected to thumb wheel 32 whereby the accumulated score may be displayed through window 23.

In order to bring the openings in the game surface and the closure plate into alignment the game surface ball release lever knob 16 is actuated by forward pressure, thereby causing it to move against flange 66 forcing flange 66 and closure plate 56 in the direction of the arrow shown in FIG. 3 and bringing the holes 78 and holes or openings 18 into alignment, allowing ball 55 to pass through the openings which now form a hole connecting into the interior of the housing 22. The ball or balls 55 seated in openings 18 fall onto plate 57 which serves as a chute having sides 65 to deliver the ball to ball return opening 15 and thereby into the ball receptacle 19 (FIG. 1). When the game surface ball release lever knob 16 is released, the tension spring 62 will bias the closure plate 56 back into its at-rest position, thereby offsetting the openings 78 and 18, and closing the game surface holes, making them merely openings into which a ball will seat again. An additional compression spring 69 biased against the housing 22 and knob 16 may be used to aid in maintaining the closed position. A pull knob (not shown) may be located opposite said knob 16 and extending for said housing for alignment of the closure plate from either side of the device.

Figure 4:
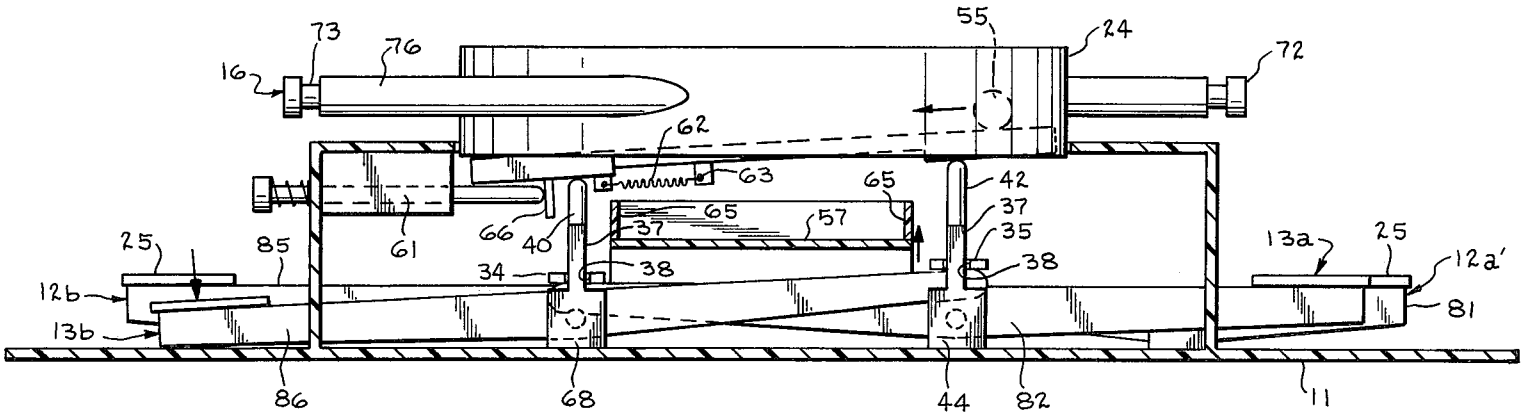
FIG. 4 is a cross-sectional elevation of the device showing a different set of levers in one mode of hand manipulation, taken along line 4—4 of FIG. 2.

The operation of a lever system as in the present device may better be seen in regard to FIGS. 3 and 4. In FIG. 3, which is a side elevation taken along line 3—3 of FIG. 2, the location of two of the proximal lever assemblies, 12*a'* and 12*b*, are depicted. In this configuration the lever assembly 12*b* has been shown to be manually depressed to the limit possible, thereby causing arm 85 to rotate in assembly 54 bringing the end of the arm 85 associated with rod 40 of FIG. 2 to bear against the beam 34, thereby causing the proximal portion (in regard to the pressed lever) of beam 34 to rise out of its at-rest, level configuration thereby tilting the game surface 17. When the manual pressure is released from lever 12*b*, tension spring 26 which is connected to housing 22 and the game surface in that quadrant, will cause the game surface 17 to return to its at-rest position by forcing the rod 40 and beam 34 downward, thereby rotating arm 85 about its pivotal mounting and bringing lever assembly 12*b* back to its normal at-rest position.

FIG. 4 is a side elevation of the device taken along line 4—4 of FIG. 2. Distal lever 13*b* is shown depressed to the maximum extent possible, thereby causing arm 86 to rotate in assembly 68 causing the end of arm 86 adjacent to the rod 42 to force beam 35 and rod 42 upward, thereby raising the distal portion of the game surface 17 in regard to the manipulation of lever 13*b* out of the at-rest configuration. Thus thereby the game surface 17 is tilted out of a level configuration since the game surface is substantially parallel with base 11, which allows a ball on the surface to roll toward the manipulator ("*b*" side) by operation of gravity. Similarly as described hereinabove upon release of the lever assembly 13*b*, the tension spring 26 located in that quadrant of the game surface 17 will bring the game surface 17 to its at-rest configuration in the housing 22 wherein it will sit on the four rods 39, 40, 41 and 42 (FIG. 6), thereby forcing lever 86 to pivot in assembly 68 bringing the lever assembly 13*b* back to its at-rest position, which will be substantially the same as shown in FIG. 4 for lever assembly 13*a'*.

FIG. 5 shows one set of mounting assemblies on the "*a*" side of the device in greater detail. Assemblies 43 and 44 are shown in detail. Assembly 43 is the pivot point for arm 79 and assembly 44 is the pivot point for arm 82. As a refinement a storage compartment 30 is provided for the game balls with lid 27 hinged by 28 to housing 22. The assemblies 68 and 71 are similarly constructed.

FIG. 6 shows the manner of the attachment of springs 26 to the housing 22 on member 20 and the attachment of the spring to closure plate support 64 on tab 47 which biases the game surface against rod 41. The retaining wall 24 sits on or is attached to member shoulder 21 of member 48 which is attached to housing 22. This same arrangement is repeated at each spring 26 shown in FIG. 2.

It is readily apparent that there are many reversals of parts which could be carried out here so that the same functions and method of operation of the present device are achieved. These parts reversals are within the scope of the invention contemplated. Furthermore, a number of variations have been described hereinbefore, however are not depicted since they are quite adequately comprehended when they are described by the written word in the specification. These modifications are also contemplated and are within the scope of the claim as set forth herein.

The invention claimed is:

1. A tiltable game surface device comprising:

a housing a game surface member having a plurality of holes therein and seated in said housing, a retaining wall located about said game surface and seated on said housing, a plurality of biasing means connecting said game surface member to said housing and biasing said game surface downward in said housing against four vertical rods, two each of said rods being affixed at opposite ends of two vertically movable beams located below said game surface member in said housing, and at least a first four adjacent levers pivotally mounted in said housing and extending from said housing and into said housing, two each of said levers being located below one of each of said beams to separately contact opposite ends of said beams for individually raising said beams.

2. The tiltable game surface device according to claim 1 wherein said rods contact said game surface members at points at least 60° apart.

3. The tiltable game surface device according to claim 1 having means in said housing for receiving balls and delivering said ball out of said housing.

4. The tiltable game surface device according to claim 1 having a closure plate slidably mounted to said game surface member and having holes therein alignable with the holes in said game surface and a biasing means tending to urge said holes in said closure plate out of alignment with the holes in said game surface member and a means for actuating said closure plate to align said holes therein with the holes in said game surface member.

5. The tiltable game surface according to claim 4 having a means for actuating said closure plate, associated with each set of levers.

6. The tiltable game surface according to claim 1 having a second group of four adjacent levers.

7. The tiltable game surface device according to claim 6 wherein said game surface is circular.

8. The tiltable game surface device according to claim 1 wherein one of said beams is located distally to said four adjacent levers and one of said beams is located proximally to said four adjacent levers.

9. The tiltable game surface device according to claim 8 wherein the two most distant of said levers extend to and below the distal beam and the two closest levers extend to and below the proximal beam, each of said levers being associated with a separate quadrant of said game surface members for raising said quadrant.

10. The tiltable game surface device according to claim 9 having a second group of four adjacent levers mounted to said housing opposite to the first group of four adjacent levers.

* * * * *